United States Patent [19]

Sharp

[11] 4,449,166

[45] May 15, 1984

[54] LIGHTING FIXTURE AND AIR FLOW SUPPORT SYSTEM

[75] Inventor: Joseph F. Sharp, Norwalk, Calif.

[73] Assignee: Ceiling Dynamics, Inc., Tucson, Ariz.

[21] Appl. No.: 478,501

[22] Filed: Mar. 24, 1983

[51] Int. Cl.[3] ..... F21S 1/02

[52] U.S. Cl. ..... 362/149; 362/150; 362/294; 362/218; 362/373; 362/404

[58] Field of Search ..... 362/149, 150, 294, 404, 362/373, 218

[56] References Cited

U.S. PATENT DOCUMENTS

| | | | |
|---|---|---|---|
| 3,101,038 | 8/1974 | Archer | 362/149 |
| 3,193,001 | 9/1974 | Meckler | 362/150 |
| 3,312,160 | 4/1967 | Rackley | 362/294 |
| 3,375,773 | 4/1968 | Wotowiec et al. | 362/150 |
| 3,636,340 | 1/1972 | Mulvey | 362/149 |
| 3,743,826 | 7/1973 | Halfaker | 362/149 |
| 4,060,025 | 11/1977 | Pelosi, Jr. | 362/373 |
| 4,161,019 | 7/1979 | Mulvey | 362/149 |
| 4,175,281 | 11/1979 | Lonseth | 362/368 |
| 4,175,360 | 11/1979 | Mulvey | 362/150 |
| 4,382,400 | 5/1983 | Stutzman | 362/294 |

*Primary Examiner*—Stephen J. Lechert, Jr.
*Assistant Examiner*—Howard J. Locker
*Attorney, Agent, or Firm*—Eugene Chovanes

[57] ABSTRACT

A combination light and air ventilation fixture for suspended ceilings is provided. A surrounding frame forms the air supply and air exhaust ducts, in addition to supporting the light producing portion of the fixture. The air ducts are substantially identical in construction, each consisting of two planar, stamped formations, joined together, with the air passageway located therebetween. A separate U-shaped, stamped formation separates the different air ducts to complete the frame. These U-shaped members are provided with lower flanges, corresponding to the lower flanges of the air ducts, and thus appear visually continuous with the air ducts. Cast corner members join the planar formations of the air ducts to the U-shaped members, forming the completed frame. Placement of the fixture in the suspended ceiling support grid is assisted by placement clips attached to the frame, which are received by slots located in the ceiling grid. The clips enable the fixtures to be easily arranged in regular geometric patterns.

35 Claims, 14 Drawing Figures

FIG. 1
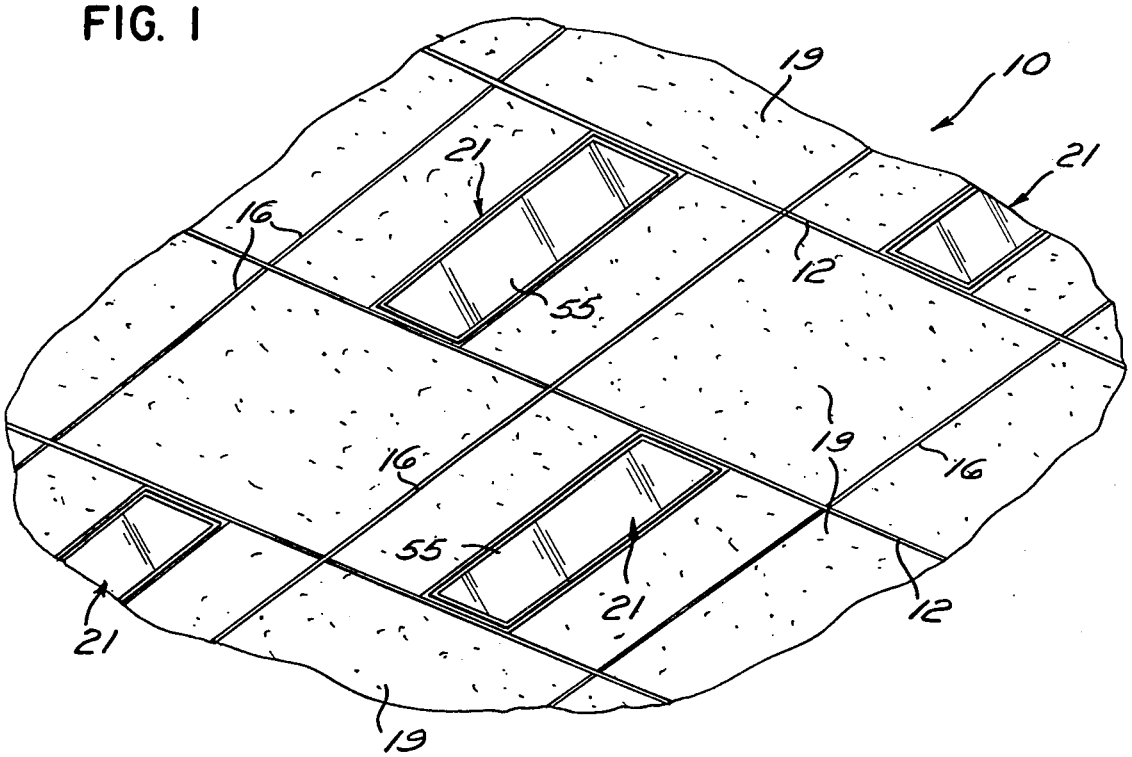
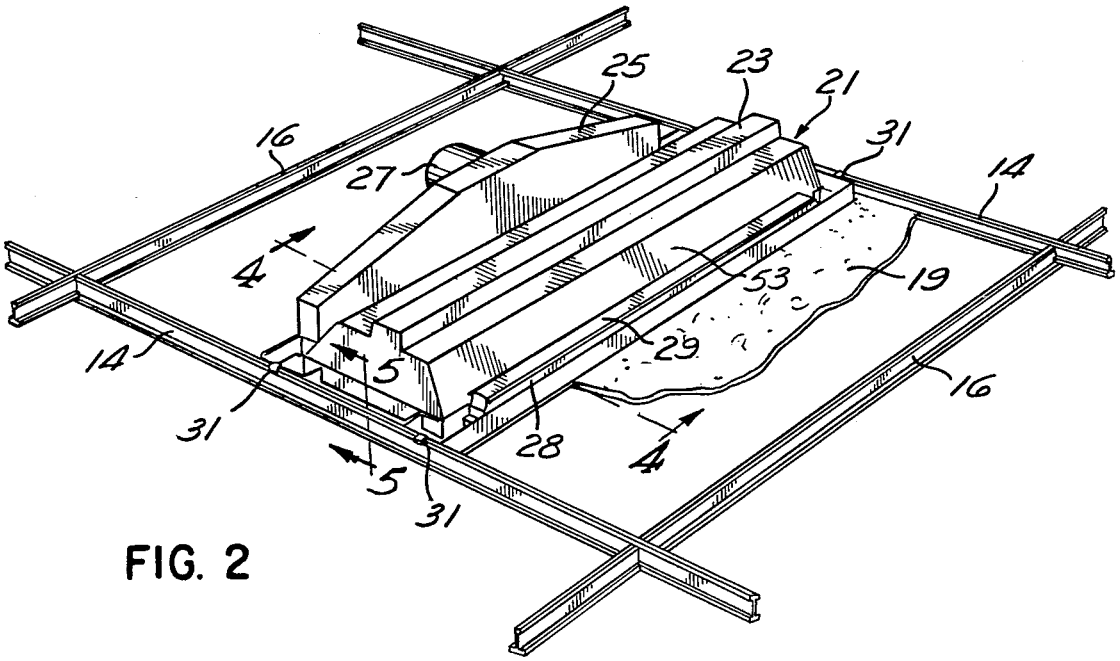
FIG. 2

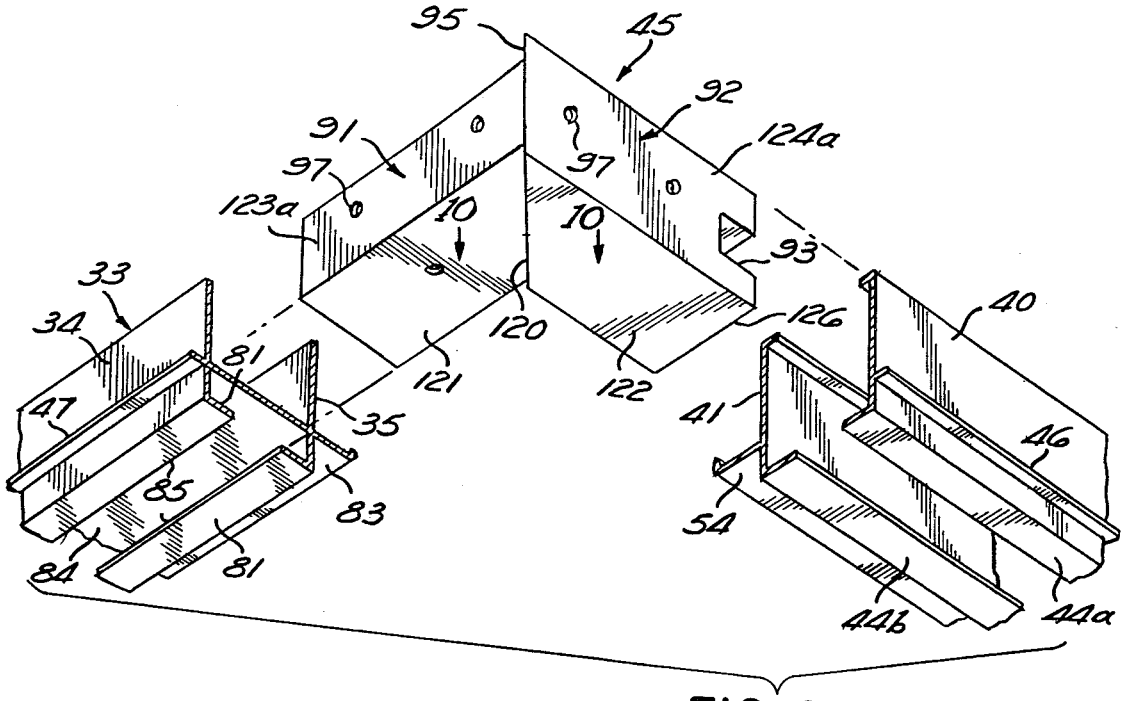
FIG. 9
FIG. 10
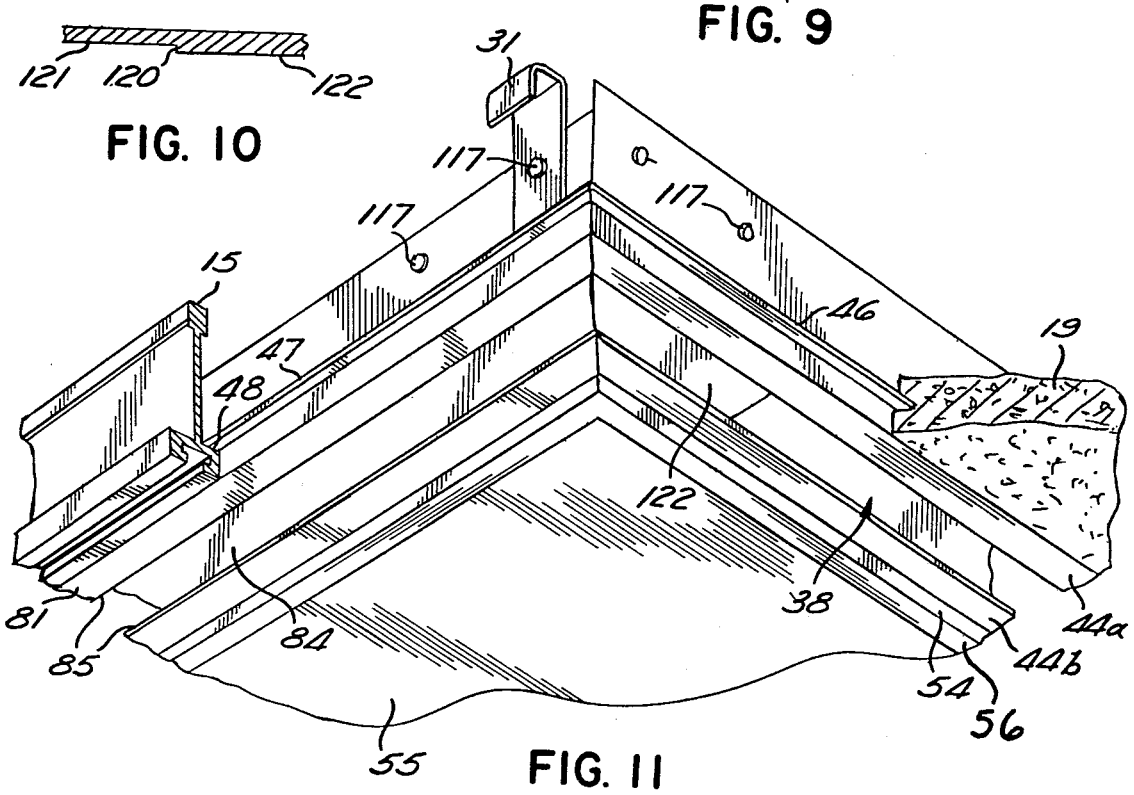
FIG. 11

13
14
33
83
35
45
47
34
117
91
31
41
43b
126
71
92
40
43a
54
46
111
93
96
122
44a
44b
86
84
112
113a
113b
116
98
121
81
85

LIGHTING FIXTURE AND AIR FLOW SUPPORT SYSTEM

BACKGROUND OF THE INVENTION

1. Field of the Invention

The present invention relates to a combination light and air ventilation fixture, and more particularly to such a fixture having a surrounding support frame, which is constructed primarily out of stamped metal formations, for use in a suspended ceiling grid system.

2. Description of the Prior Art

Suspended ceiling systems are extensively used throughout the construction industry, both in new building construction and in the renovation of older buildings. A suspended ceiling consists of a grid-like support base suspended from the "true" ceiling, the base supporting a layer of ceiling panels, typically acoustical tile. In addition, the suspended grid frequently serves as a support base for the lighting fixtures and heating and air conditioning outlet ducts. The available space between the true ceiling and the false or suspended ceiling enables the economical placement of the air ventilation ductwork required to supply the individual ducts in comparison to the previously utilized floor and/or wall constructions.

For many years after the introduction of forced-air heating and cooling systems, the ceiling ducts were essentially individual louvered openings located in the ceiling. These openings typically formed arrays corresponding to the location of the (sometimes hidden) ventilation ductwork. Incandescent light bulbs and their associated fixtures did not lend themselves toward the utilization of combined lighting and air ventilation systems. However, with the advent of fluorescent lighting, architects were provided with numerous large, rectangular ceiling light fixtures, with sufficient surface area to make concurrent usage for air ventilation practicable.

In some of these early combination fixtures, the forced air was introduced directly into the light reflection area with it exhausting into the room through the open bottom of the light fixture. Later, when the light fixtures were provided with translucent panels to help diffuse the light, air gaps were left along the sides of the panels to permit the discharge of the air into the room. In a slightly different construction, such light and air fixtures were provided with an outer covering or hood which surrounded the light reflection unit and created a passageway for the airflow. The hood portion terminated at the bottom of the light fixture, creating a surrounding, spaced border through which the air is discharged into the room. These fixtures could alternatively function as an air exhaust vent, removing air. The next progression found these fixtures providing the capability for complete air ventilation, both forced air supply and exhaust, in the same lighting fixture. Various baffles and plenums were used to segregate the two air streams. A lateral opening along each side of the fixture was provided, one for discharging air into the room and the other for exhausting it from the room. With the baffles and separate air passageways, these normally unitized lighting fixtures were somewhat complex in manufacture. In addition to their complexity, there normally was also an aesthetic requirement for a surrounding border construction for the fixture installation, complementing the two, lengthy lateral air openings. This resulted in additional labor requirements during installation.

SUMMARY OF THE INVENTION

The present invention has as an underlying objective, the improvement in the heretofore-known types of combination light and air ventilation suspended ceiling fixtures by the provision of an easily-manufactured surrounding support frame for the fixture. This surrounding support frame utilizes a minimal number of stamped metal formations, connected by a cast corner member. The resulting frame receives the light reflection unit, and the entire construction is then mounted in a ceiling grid structure. In addition to supporting the fixture, the support frame also contains separated passageways for the airflow into and out of the room. The support frame further simplifies installation into a ceiling grid by also functioning as an integral border, forming a simple and aesthetically acceptable connection with the surrounding acoustical tile.

This goal is inventively achieved by providing a surrounding support frame which utilizes a small number of readily interchangeable components. The basic parts for both the air inlet and air discharge portions of the frame are identical. Two complementary, predominantly planar stamped formations are placed on their sides, longitudinally opposite one another. Flanges are provided along the top and bottom lateral edges, and extend towards one another to form elongated openings. In the finished construction, an air supply source is placed adjacent the upper opening of the frame, with the air then passing vertically through the frame, to be discharged into the room through the lower opening. On the opposite side of the lighting fixture, a similar structure is provided, and the reverse process occurs. Air from the room enters the lower opening, passes through the frame, and is discharged into the space above the fixture through the upper opening of the frame.

The lateral members located on opposite sides of the lighting fixture are connected to one another at both ends by cross members. These cross members are identical, stamped formations, which are substantially U-shaped in plan. The side walls extend below the floor of the "U", terminating in flanges which extend toward one another forming a false opening, which corresponds in width to the air discharge and air exhaust frame openings. In the completed construction, a continuous peripheral slot is thereby formed extending circumferentially around the exterior of the lighting fixture. This slot functions as the lower opening for the air discharge and exhaust systems as well as a decorative border. To prevent the aesthetically undesirable leakage of light from the area above the false ceiling through the air exhaust gap, a guard plate located directly above and adjacent the upper opening of the exhaust gap is provided. There is no light leakage problem with the remainder of the surrounding slot due to the connection with the air supply system and the false openings of the cross member.

The lateral members and the cross-connecting members are connected to one another by cast corner pieces. These corner pieces or members have extensions in two directions, one extension being received by the lateral member construction and the other by the U-shape cross member. The corner member is also provided with a floor or base which is sufficiently off-set so that the base of the cross member extension rests upon the floor of the U-shaped channel permitting the floor of the lateral member extension of the corner member to be coplanar with the bottom of the U-shaped cross member extension. The corner member is also sized so that when the cross member and lateral member are joined, the lower flanges for both of these members also lie in the same plane, thus obtaining a single level for the surrounding border/opening.

The connection of both of the cross members and the lateral members by the corner members, creates a surrounding supporting frame which is sized so as to receive and support a light reflection unit. Projecting shelves extending from the inside lateral members and the inside portion of the cross members, are provided for this purpose. Similarily, extending from the outside portions of the lateral members and cross members is a projecting ledge which is received by the lower flanges of the ceiling support grid structure, supporting the light and air fixture in the grid system.

The fixtures may be randomly placed throughout the ceiling grid or at pre-selected locations to form geometric patterns. To achieve the latter, slots are provided at regularly spaced locations in the top portion of the main and cross runners in the grid. Placement clips are attached to the cross runners of the support frame, and are received by the slots. In this manner, the fixtures can be easily arranged through the grid, in the pre-selected slot locations, forming regular patterns.

Various other objects, advantages, and features of the present invention will become readily apparent from the ensuing detailed description, and the novel features will be particularly pointed out in the appended claims.

BRIEF DESCRIPTION OF THE DRAWINGS

FIG. 1 is a fragmentary bottom perspective view showing a suspended acoustical ceiling having light and air ventilation fixtures, as viewed from below;

FIG. 2 is a fragmentary bottom perspective view from above showing a suspended ceiling light and air ventilation fixture as placed in a suspended ceiling grid;

FIG. 9 is an exploded, partial perspective view taken from below, showing a corner connection in a suspended support frame for a ceiling light and air ventilation fixture according to the present invention;

FIG. 10 is a fragmentary elevational view, in section, taken along the line 10—10 of FIG. 9, showing a vertical off-set in the bottom of a corner member, according to the present invention;

FIG. 11 is a partial perspective view taken from below with portions broken away, showing an assembled corner connection in a suspended support frame for a ceiling, light and air ventilation fixture according to the present invention;

DESCRIPTION OF THE PREFERRED EMBODIMENT

Figures 3, 6:
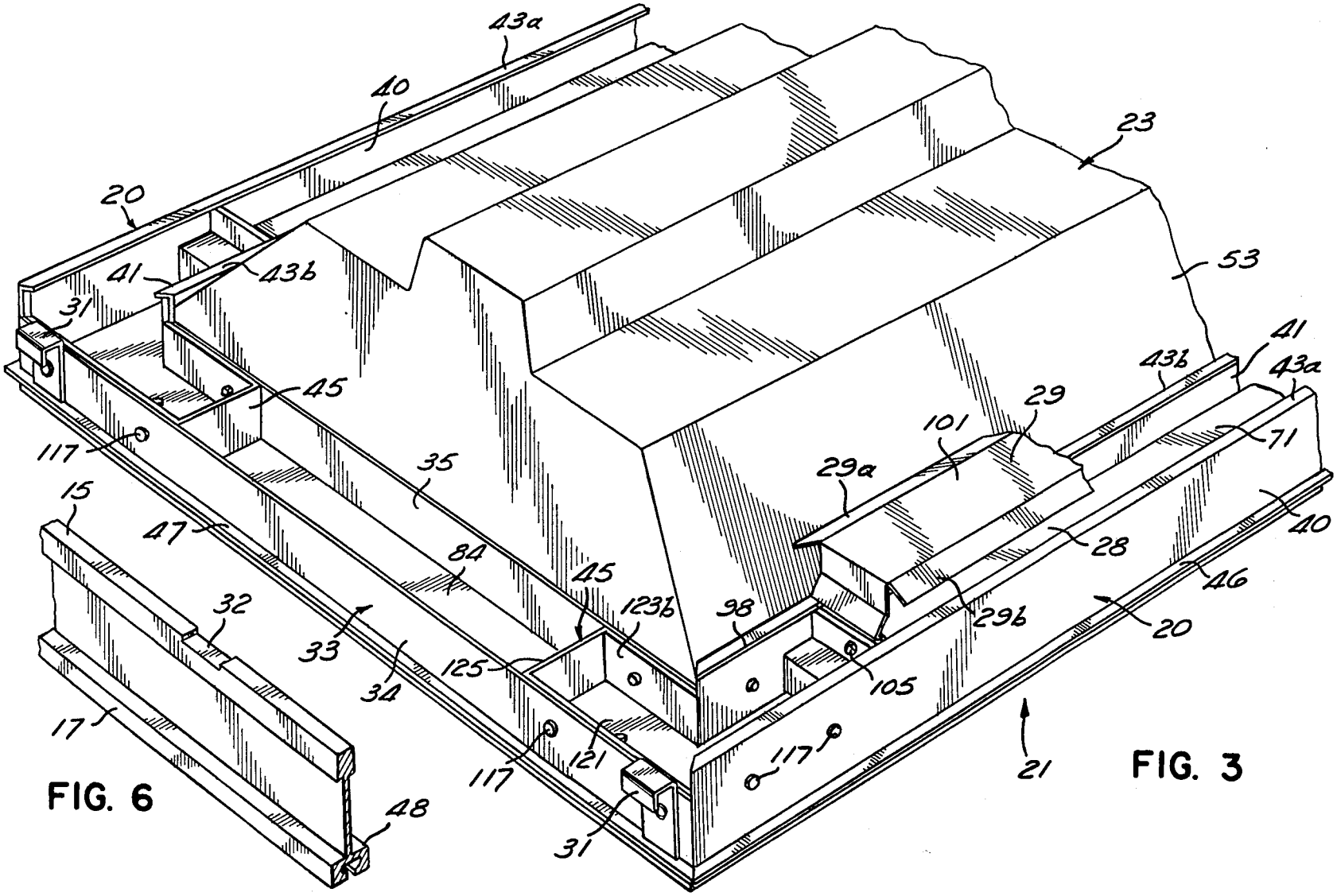
FIG. 3 is an enlarged perspective view showing a portion the invention comprising a suspended ceiling light and air ventilation fixture.
FIG. 6 is a partial perspective view showing a portion of a ceiling grid system member.

FIG. 1 shows a portion of a suspended grid support system 10, used to form a suspended or false ceiling. As seen from below, the grid system 10 includes a plurality of longitudinal beams 12, in a spaced, parallel relationship. Each longitudinal beam 12 comprises one or more main runners 14, connected in end-to-end relationship and spliced together (not shown). A plurality of cross runners 16 are positioned in parallel, spaced arrangement, normal to the adjacent longitudinal beams 12, and intersecting therewith. Thus, the cross runners 16 and the main runners 14, (which form the longitudinal beams 12), cooperate to form the grid system 10. As is also shown in FIG. 1, in addition to supporting ceiling panels 19 such as acoustical tile or the like, the grid system 10 also supports a plurality of fixtures 21, which provide artificial lighting and air ventilation.

As seen from above in FIG. 2, the bi-functionality of the fixture 21 is achieved by providing two separate systems in the fixture: air inlet/exhaust system and a lighting system. The lighting system is of a conventional fluorescent type having a light emitting source (shown schematically in FIG. 4) contained in a light reflection unit 23. The air inlet/exhaust system is then located on both sides of the light reflecting unit 23. As shown in FIG. 2, air enters the fixture 21 through an air inlet 27 directly into a plenum 25 located adjacent to a lateral side of the light reflection unit 23. Adjacent to the other side of the light reflection unit 23 is the air discharge system, having an air exhaust channel 28 laterally extending along the light reflection unit 23. An air discharge channel guard 29 is provided in a vertically superimposed relation to the exhaust channel 28. The fixtures 21 are also provided with a plurality of placement clips 31 which enable the placement of the fixtures 21 at pre-determined locations along the main runners 14 or cross runners 16.

As shown in FIG. 3, the composite fixture 21 consists of the light reflection unit 23 and a surrounding support frame 20. The air pathways located on both lateral sides of the light reflection unit 23 are each formed by a construction consisting of an outside lateral frame member 40 and an inside lateral frame member 41. A cross frame member 33 located at each end of the light reflection unit 23 completes the surrounding support frame 20. The lateral frame members 40,41 are joined together using a corner member 45 located at each end of the frame members 40,41. The corner member 45 is also utilized to join the lateral frame members 40,41 to the cross frame members 33, thus forming the surrounding support frame 20.

As is also shown in FIG. 3, the air discharge channel guard 29 is provided with bent, overhanging portions or eaves 29*a* and 29*b* along both lateral sides of the channel guard 29. The air exhaust channel 28 is thus formed on both lateral sides of the air channel guard 29 between the eves 29*a*, 29*b* and the upper portion of the lateral frame members 40, 41.

Figure 4:
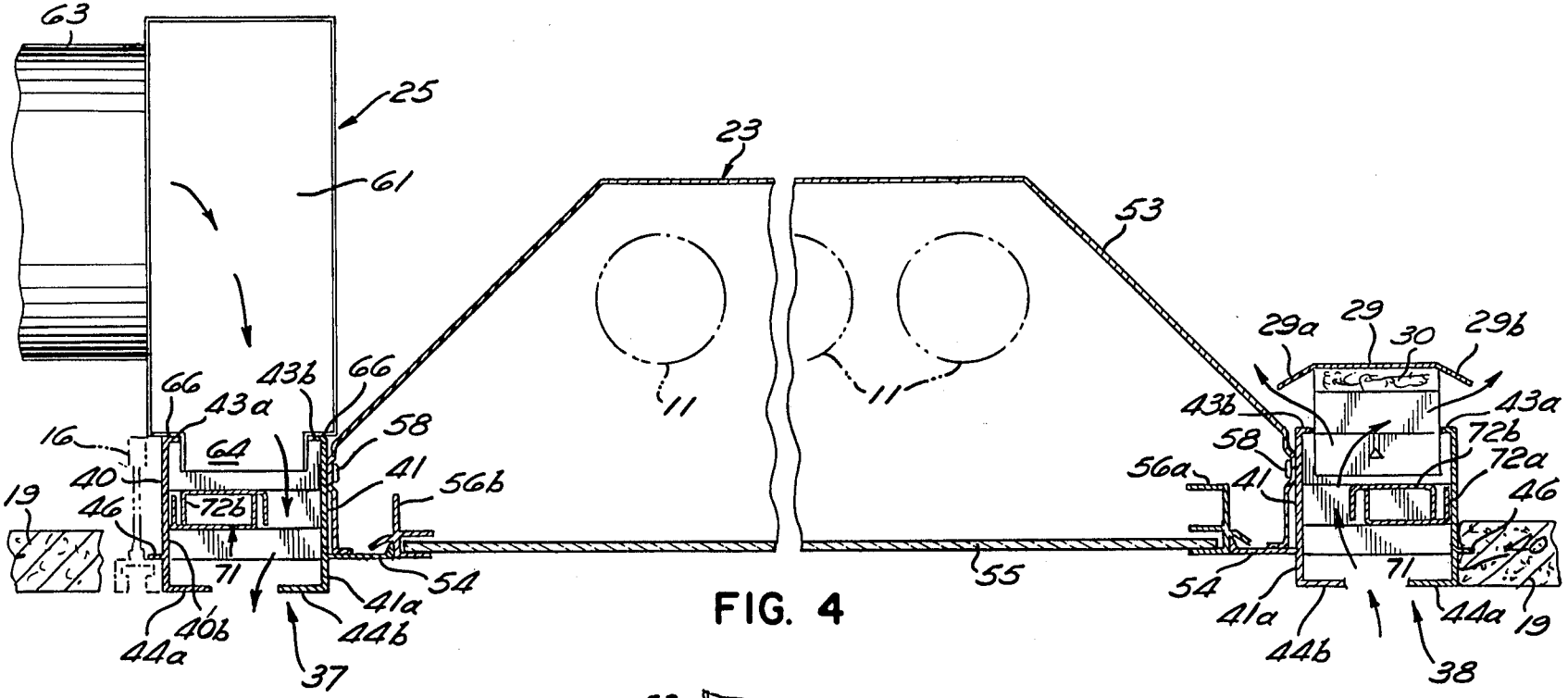
FIG. 4 is a side elevational view, in cross section, showing a suspended light and ventilation fixture as mounted in a ceiling.
Figures 7, 8:
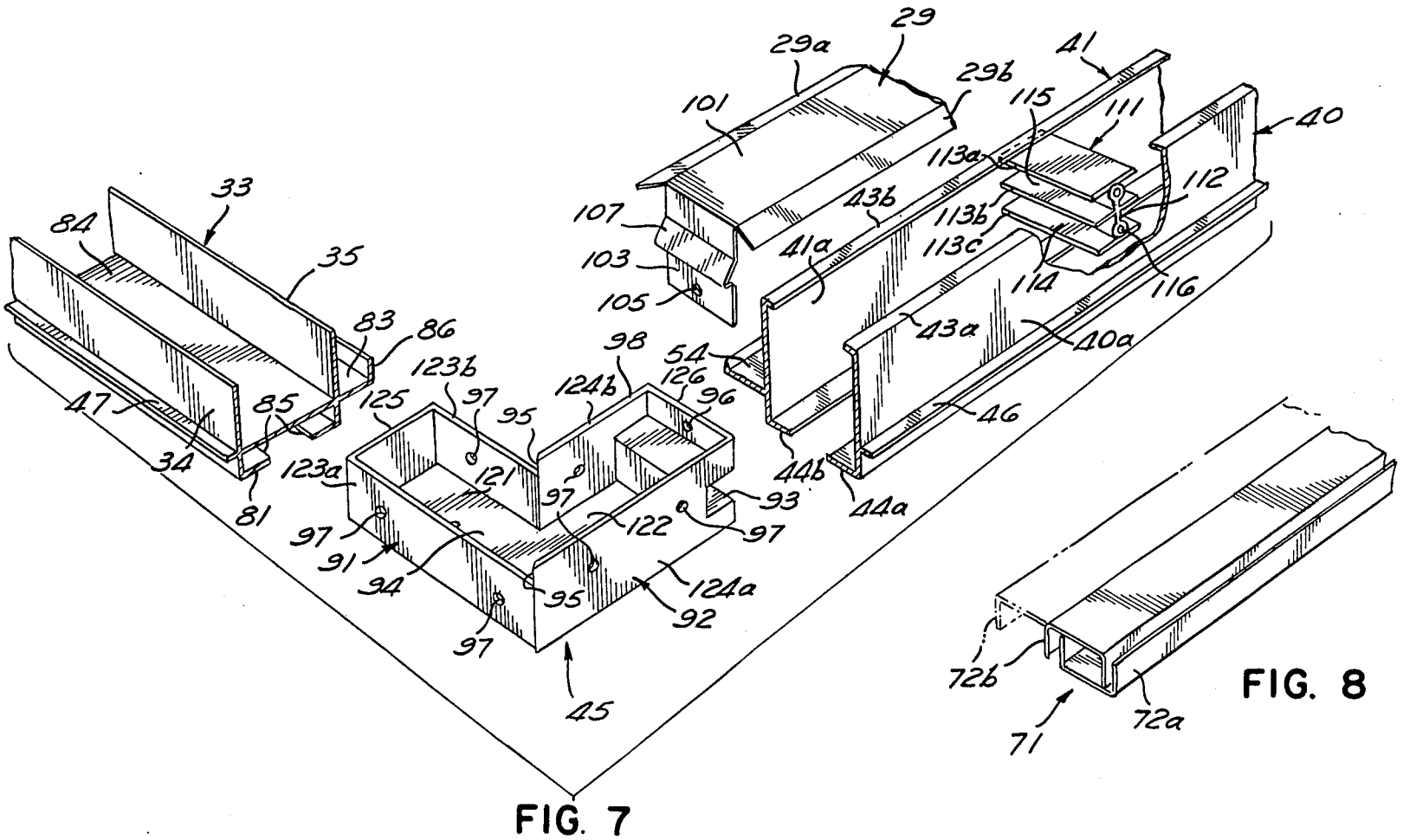
FIG. 7 is an exploded, partial perspective view, with portions broken away, showing a corner connection in a suspended support frame for a ceiling light and air ventilation fixture according to the present invention.
FIG. 8 is a partial perspective view showing channel stock utilized for air flow control, alternate lateral positions indicated in phantom.

The outside lateral frame member 40 is provided with an outer wall 40*a* having a lateral frame supporting rib 46 formed therein, see FIGS. 4 and 7. Similarily, the cross frame member 33 has a cross frame supporting rib 47 formed therein. The supporting ribs 46,47 are of such a size so as to support the overall fixture 21 in the grid system 10 by resting upon an upper surface 48 of a flange portion 17 formed in the main and cross runners 14, 16. The placement clips 31, which are attached either to the cross frame member 33 or the lateral member 40 (not shown), do not support the fixture 21, but rather are utilized to position the fixture at selected locations which have been pre-determined according to the placement of a plurality of slots 32 formed in an upper box portion 15 of the main runners 14 and cross runners 16, as is shown in FIG. 6. The placement clips 31 are received by the slots 32, which enables the precise arrangement of the fixtures 21 (also see FIG. 5). In an alternate embodiment (not shown), where it is desired to provide a linear arrangement or row of the fixtures 21, each pair of placement clips 31 are off-set from one another to permit the end-to-end placement of the fixtures without interference between the respective pairs of replacement chips 31. The location of the slots 32 will, or course, conform to the location of these off-set placement clips 31.

Figure 5:
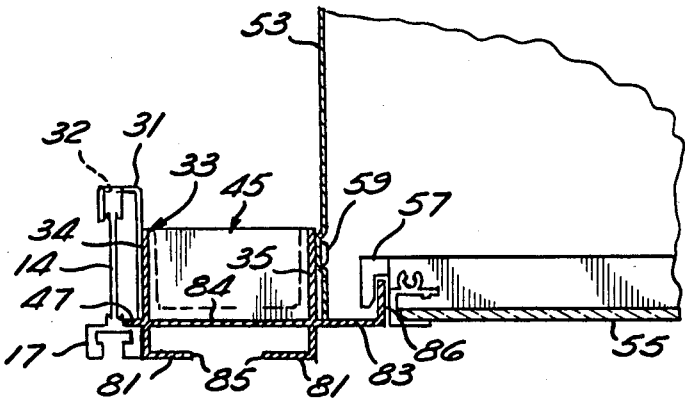
FIG. 5 is a partial side elevational view, in section, showing the mounting of a suspended ceiling light and air ventilation fixture on a main runner of a ceiling grid system.

Additional details of the fixtures 21 and particularly the surrounding support frame 20 are shown in the cross sectional views of FIGS. 4 and 5. As is shown in FIG. 4, an air inlet duct 37 and an air exhaust duct 38 are constructed in substantially the same manner, consisting of the outside lateral frame member 40 and the inside lateral member 41. The lateral frame members 40,41 are complimentary, stamped formations, having an upper flange 43*a*,43*b* and lower flange 44*a*,44*b*, respectively. Both sets of flanges extend toward one another, the upper flanges 43*a*,43*b* forming a support shoulder 66 which receives the lower portion of the plenum 25. The lower flanges 44*a*,44*b* extend toward one another forming the lower opening for the air inlet duct 37.

A projecting shelf 54 is provided on an outer wall 41*a* of the inside lateral frame member 41 in each of the air ducts 37, 38. The projecting shelf 54 receives and supports a portion of the light reflection unit 23. A retaining means 58 is also used to attach the light reflection unit 23 to the inside lateral frame member 41. As is also shown in FIG. 4, the light reflection unit 23 is provided with an outer, light reflecting hood 53 and a light transmitting panel 55. A pair of panel retaining strips 56*a*, 56*b*, shown generally as retaining strip 56 in FIG. 11, receive the panel 55 and are themselves attached to the projecting shelves 54, which in turn support the light transmitting panel 55.

The function of the lateral frame supporting rib 46 will vary according to the location of the fixture 21 in the suspended grid system 10. Where the fixture 21 is adjacent to either the main runner 14 or the cross runner 16 (shown in phantom), the respective supporting rib 46,47 will be received by the upper surface 48. The respective supporting rib 46,47 will thus assist in the support of the fixture 21. However, when the fixture 21 is not adjacent to either the main runner 14 or the cross runner 16, the respective supporting rib 46,47 will receive and support the ceiling panels 19.

To control the amount of air flowing through the fixture 21, both the air inlet duct 37 and air exhaust duct 38 are provided with a mechanism that alters the size of the air passageway. A weir 71 (also see FIG. 8) is formed inside both of the air ducts 37,38 by a complementary pair of U-shaped channel stock 72*a*,72*b*. As is shown in FIG. 4, the weir 71 is received between the lateral frame members 40,41. The two channel stock members 72*a*,72*b* cooperate as a unit, the channel stock 72*b* is inverted and received by the channel stock 72*a*. As is shown in FIG. 8, this construction permits the lateral expansion of the weir 71, reducing the size of the air passageways and restricting the amount of air flow.

Unlike the lateral portion of the support frame 20 which consists of a construction of two separate members - the inside and outside lateral frame members 41,40, the cross frame member 33 is a single, unitary stamped formation of generally U-shaped design, see FIG. 5. The cross frame member 33 is provided with an outer sidewall 34 and an inner sidewall 35 joined together by a base or bed portion 84. The outer and inner sidewalls 34,35, extend below the base 84, terminating in a pair of lower flanges 81. The cross frame supporting rib 47 projects from the outer sidewall 34, and a projecting shelf 83 extends from the inner sidewall 35. Both the supporting rib 47 and the projecting shelf 83 are coplanar with the base 84. The projecting shelf 83 is sized to receive and support a portion of the outer reflecting hood 53. A retaining means 59 may also be used to secure the reflecting hood 53 to the inner sidewall 35 of the cross frame member 33. The projecting shelf 83 terminates in a lip 86 which, in conjunction with a hanger assembly 57, also assists in the support of the light transmitting panel 55.

The cross frame member 33 is joined to the lateral frame members 40,41 by the corner member 45, as is illustrated in detail in the exploded view provided by FIG. 7. Unlike the cross frame members 33 and the lateral frame members 40,41, both of which are extruded formations, the corner members 45 are cast formations having a cross frame extension 91 and a lateral frame extension 92 formed at a selected angle to one another, depending upon the chosen geometric shape of the surrounding support frame 20. For purposes of illustration, a rectangular shape has been shown in the Figures. The cross frame extension 91 consists of a cross frame outer sidewall 123*a* and a cross frame inner sidewall 123*b* with a cross frame end wall 125 connecting the sidewalls 123*a*,123*b* at their forward terminus. Similarly, the lateral frame extension 92 consists of a lateral frame outer sidewall 124*a* and a lateral frame inner sidewall 124*b* connected by a lateral frame end wall 126 at the forward terminus of the lateral frame extension 92. The corner member 45 is also provided with a floor 94, consisting of a cross frame base extension 121 and a lateral frame base extension 122 (see FIG. 9).

To form the connection between the cross frame member 33 and the lateral frame members 40,41, the adjacent ends of the lateral members 40, 41 and cross frame member 33 are mitered at the selected corner angle. The cross frame extension 91 is then received by the U-shaped channel of the cross frame member 33, with the cross frame base extension 121 resting upon the base 84 of the cross frame member 33. Similarly, the lateral frame extension 92 is received between the outside lateral frame member 40 and the inside lateral frame member 41. A top edge 98 of the lateral frame extension 92 receives the upper flanges 43*a*,43*b* of the lateral frame members 40,41.

In order to provide sufficient room for the weir 71 and also a quieter air flow, it is desirable to have a greater vertical height in the lateral frame members 40,41 than is necessary in the cross frame members 33. To enable the resulting support frame 20 to have the air inlet and air exhaust ducts 37,38 coplanar with the false air ducts 85 in the cross frame member 33, the lateral frame sidewalls 124*a*,124*b* are of a sufficient vertical dimension so that the lateral frame members 40,41 hang down from the top edge 98 to the correct, coplanar level. Since there is no similar requirement for vertical height in the cross frame extension 91, a vertical offset 95 is provided in the corner member 45 at the intersection between the lateral frame outer sidewall 124*a* and the cross frame outer sidewall 123*a*, as well as between the lateral frame inner sidewall 124*b* and the cross frame inner sidewall 123*b*. The vertical height of the cross frame sidewalls 123*a*,123*b* is desirably no higher than the outer and inner sidewalls 34,35 of the cross frame member 33.

To provide additional structural rigidity along the length of the lateral frame members 40,41, one or more spacer units 111 are provided. Each spacer unit 111 consists of a vertical member 112 separating three flanges 113*a*,113*b*,113*c*, which in turn form a lower slot 114 and an upper slot 115.

In addition to improving the stability for the lateral member construction (which forms the air inlet duct 37 and the air exhaust duct 38), the spacer units 111 also provide support for one end of the air flow weir 71. The U-shaped channel stocks 72*a*,72*b* is received by a platform 93 formed in the lateral frame end wall 126 of the corner member 45. From the platform 93, the channel stocks 72*a*,72*b* horizontally extend to the corresponding slot 114, 115 in the spacer unit 111. The spacer unit 111 is substantially symmetrical about its central axis and thus may be inverted without detrimental effect to its receiving of the channel stock 72*a*,72*b*. Both the platform 93 and the lower and upper slots 114,115 provide sufficient lateral space to permit the weir 71 to variably alter its lateral dimensions and thereby alter the air flow.

FIG. 7 also illustrates the air discharge channel guard 29 in greater detail. The channel guard 29 is a stamped, predominantly planar formation, consisting principally of a cover panel 101 and at least one and preferably two end support panels 103. The eaves 29*a*, 29*b* are located along the outer lateral edges of the cover panel 101. The end support panels 103 (only one is shown) are bent downwardly, substantially perpendicularly to the cover panel 101, and are further provided with an additional bend or crimp 107 to provide additional structural rigidity. A holding tab 105 or any such other like connector means is provided on the lower end portion of the end support panel 103, utilized to connect the end support panel 103 with the lateral frame end wall 126 of the corner member 45. When assembled, as shown in FIG. 3, the end support panel 103 maintains the cover panel 101 in a spaced-apart relationship to the upper flanges 43*a*, 43*b* of the lateral frame members 40, 41. The cover panel 101 and the eaves 29*a*, 29*b* prevent what would otherwise be direct visual access from below the fixture 21 into the area above the false ceiling. An insulation material 30 may also be provided to the underside of the cover panel 101, as is shown in FIG. 4.

As was previously described, the bottom surfaces of the lower flanges 81 of the cross frame member 33 are coplanar in the assembled condition with the lower flanges 44*a*, 44*b* of the lateral frame members 40, 41, see FIG. 9. In addition, the bottom surface of the bed 84 of the cross frame member 33 is coplanar with the bottom surface of the lateral frame base extension 122. As is shown in FIG. 9, this is accomplished by providing a base offset 120 in the corner member 45. The base offset 120 corresponds in depth to the thickness of the bed 84 of the cross frame member 33. Thus, when the cross frame base extension 121 is received by the cross frame member 33, resting upon the upper surface of the bed 84, the lower surface of the bed 84 is coplanar with the bottom surface of the lateral frame base extension 122 of the corner member 45. The base offset 120 is shown in detail in FIG. 10, and the resulting connection is shown in FIG. 11.

FIG. 11 also illustrates the continuous nature of the ducts or openings, which is achieved by the coplanarity of the lower flanges 81 of the cross frame member 33 with the lower flanges 44*a*, 44*b* of the lateral frame members 40, 41. The false air duct 85 appears to be a continuous extension of both the air inlet duct 37 and the air exhaust duct 38. In the completed fixture 21, there is thus provided a continuous opening around the periphery of the fixture 10, consisting of the false air ducts 85 and the air inlet and air exhaust ducts 37, 38.

Figures 12, 13, 14:
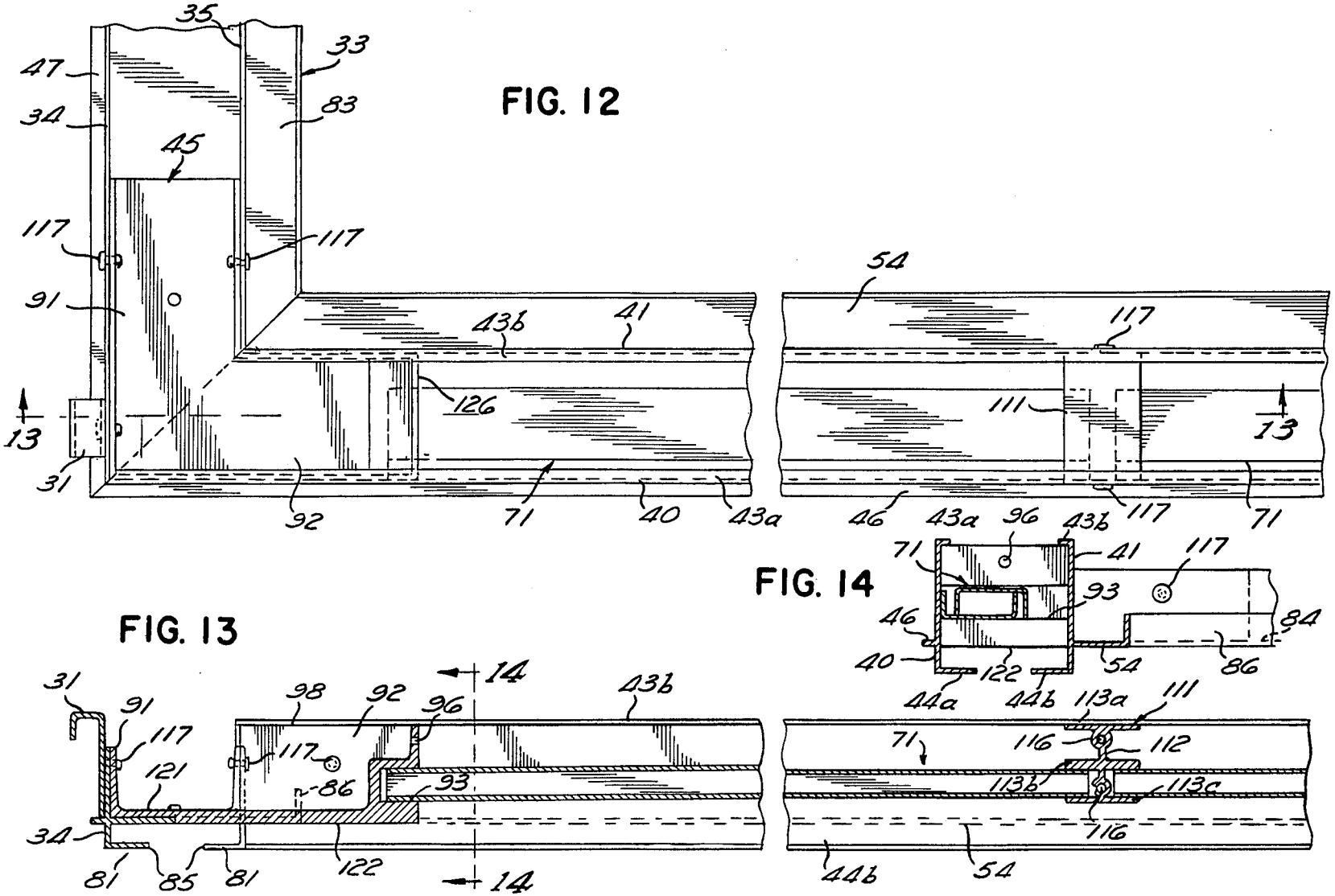
FIG. 12 is a partial plan view with certain linear portions omitted, showing a corner connection of a surrounding support frame assembly for a suspended ceiling fixture according to the present invention.
FIG. 13 is an elevational view in section taken along the line 13—13 of FIG. 12, showing portions of surrounding support frame assembly for a suspended ceiling fixture according to the present invention.
FIG. 14 is a fragmentary elevational view, in section, taken along the line of 14—14 of FIG. 13 showing a cross section of a lateral frame member of a surrounding support frame according to the present invention.

As is shown in FIGS. 12 and 13, the assembled construction is held together by a plurality of rivets or like connector means 117. Apertures 97 are formed in the corner member 45 and may be formed in the side walls 34, 35 of the cross frame member 33 and the lateral frame members 40, 41 during assembly. An aperture 96 is formed in the lateral frame end wall 126 of the corner member 45 to receive the holding tab 105 of the end support panel 103 for the channel guard 29. Additionally, one or more apertures 116 are provided in the spacer units 112 to receive connecting rivets 117.

As finally assembled, the lighting and air flow fixture 21, as shown in FIG. 4, provides for both lighting and air ventilation. Light is conventionally provided, utilizing the light-producing means 11 shown schematically inside of the light reflection unit 23. Air ventilation is provided utilizing the air inlet and air exhaust ducts 37, 38 located on each lateral side of the light reflection unit 23. The ducts 37, 38 are essentially identical in construction, forming a part of the surrounding support frame 20 for the fixture 21, distinguishable only by the provision of the plenum 25 for the air inlet duct 37 and the air discharge channel guard 29 for the air exhaust duct 38. As both of these items are readily interchangeable, the fixture 21 is readily adaptable to differing ventilation ductwork patterns.

The air flow through both the air inlet duct 37 and the air exhaust duct 38 is quite similar. Air is supplied to the fixture 21 by an air supply duct 63. From the supply duct 63, air enters into an air chamber 61 of the plenum 25 and is discharged through an air discharge opening 64, which is received by, and located between, the lateral frame members 40, 41. The air then moves vertically downward, passing the airflow control weir 71, and out through the opening formed between the lower flanges 44*a*, 44*b* of the lateral frame members 40, 41.

The air flow through the air exhaust duct 38 is essentially the reverse of the foregoing process. The air between the false and true ceilings is subjected to a slight reduction in pressure, as compared to the air in the space below the false ceiling. This pressure difference causes the air from below to enter the air exhaust duct 38 through the opening formed between the lower flanges 44*a*, 44*b* of the lower frame members 40,41. The air then flows past the airflow control weir 71 and out of the air exhaust duct 38 through the opening formed between the upper flanges 43*a*, 43*b* of the lateral frame members 40, 41 and the eaves 29*a*, 29*b* of the air discharge channel guard 29.

While I have disclosed an exemplary structure to illustrate the principles of the present invention, it should be understood that I wish to embody within the scope of the patent warranted hereon, all such modifications as reasonably and properly come within the scope of my contribution to the art.

I claim:

1. A suspended composite ceiling light and air ventilation fixture comprising:

a light-producing means, a light-reflection unit surrounding and containing said light-producing means, a multi-function support frame surrounding and operatively attached to the light-reflection unit, said support frame including air inlet means adjacent to and extending along a lateral side portion of the light-reflection unit, an air discharge means laterally adjacent to and extending along the light reflection unit at a location opposite that of said air inlet means, false air duct means laterally adjacent the light-relection unit, and located between opposing ends of the air discharge and air inlet means, means joining said false air duct means to ends of the air discharge and air inlet means and forming a portion of said support frame, and means for selectively positioning and attaching said support frame and combined components thereof to a suspended ceiling grid system.

2. A suspended ceiling fixture as described in claim 1, wherein said means for selectively attaching the support frame to the ceiling grid system comprises:

a supporting rib attached to and projecting from the surrounding support frame, said rib sized to engage with and rest upon a flange portion of an adjacent main or cross-runner assembly of the ceiling grid system.

3. A suspended ceiling fixture as described in claim 2, wherein said selective attaching means further comprises:

at least one placement clip attached to the surrounding support frame; and a plurality of slots selectively located in the adjacent main or cross runner assemblies, each of said slots of a size sufficient to receive one of said placement clips, whereby the ceiling fixture may be positioned at predetermined locations about the ceiling grid system.

4. A suspended ceiling fixture as described in claim 1, wherein the air inlet means comprises:

a box channel having an upper and lower longitudinal opening formed therein; and an air supply duct having means for connecting the duct with the upper channel opening, whereby air from the supply duct enters the box channel through the upper opening and is discharged through the lower opening.

5. A suspended ceiling fixture as described in claim 4, wherein said means for connecting the air supply duct with the upper channel opening comprises a plenum having an air chamber connected to the air supply duct and an air discharge opening adjacent the upper channel opening.

6. A suspended ceiling fixture as described in claim 4, and additionally comprising an airflow regulating weir means located within the box channel.

7. A suspended ceiling fixture as described in claim 6, wherein said box channel comprises:

an inside lateral frame member having inner and outer walls attached to the light reflection unit;

an outside lateral frame member having inner and outer walls; and at least one spacer unit lying between and attached to the inner walls of both the inside frame member and the outside frame member.

8. A suspended ceiling fixture as described in claim 7, wherein one or more slots are provided in the spacer unit, and sized to receive and support said airflow regulating means.

9. A suspended ceiling fixture as described in claim 7, wherein a projecting shelf is provided on the outer wall of the inside frame member, said shelf supporting a portion of the light-reflection unit.

10. A suspended ceiling fixture as described in claim 4, wherein the air discharge means comprises:

a box channel having an upper and lower longitudinal opening formed therein; and an air discharge channel guard comprising:

a cover panel located vertically above and in an over-lapping relation to the upper longitudinal opening, forming air exhaust channels located on each side of the cover panel, between the panel and the upper longitudinal opening, and at least one side support panel attached to said cover panel, connecting the cover panel to the support frame and maintaining the vertically-spaced relationship, whereby air may enter the discharge box channel through the lower opening and be discharged through the upper opening, out through the exhaust channels.

11. A suspended ceiling fixture as described in claim 10, and additionally comprising an air flow regulating means located within the box channel.

12. A suspended ceiling fixture as described in claim 11, wherein said discharge box channel comprises:

an inside lateral frame member having inner and outer walls attached to the light-reflection unit;

an outside lateral frame member having inner and outer walls; and at least one spacer unit lying between and joining the outside frame member to the inside frame member.

13. A suspended ceiling fixture as described in claim 12, wherein one or more slots are provided in the spacer unit and sized to receive and support the airflow regulating means.

14. A suspended ceiling fixture as described in claim 12, wherein a projecting shelf is provided on the outer wall of the inside frame member, said shelf supporting a portion of the light-reflection unit.

15. A suspended ceiling fixture as described in claim 4, wherein the false air duct means comprises:

a U-shaped channel having an inner and outer side wall separated by a planer section forming a floor, said side walls project downwardly beyond the floor forming lower flanges which together cooperate to form a false opening, resembling the lower openings formed by the air inlet and air discharge means.

16. A suspended ceiling fixture as described in claim 15, wherein a projecting shelf is provided on the outer side of the inner side wall, said shelf supporting a portion of the light-reflection unit.

17. A suspended ceiling fixture as described in claim 15, wherein said means joining the false duct means to ends of the air discharge and air inlet means comprises:

a plurality of cast corner members, each of which comprise a cross frame extension, sized to be received by the U-shaped channel of said false air duct means; and a lateral frame extension sized to be received by the box channel of said air inlet means or the box channel of said air discharge means.

18. In a suspended ceiling light and air ventilation fixture, a surrounding composite light and air ventilation fixture support frame comprising:

a pair of lateral frame members forming an air inlet means;

a separate pair of lateral frame members forming an air discharge means;

a pair of cross-frame members forming false air duct means; and means joining alternate end portions of the first and second frame members forming a continuous polygonal support frame.

19. A composite surrounding support frame as described in claim 18, wherein said lateral frame members further comprise an outside frame member and an inside frame member, said outside frame member comprising:

an extruded formation which further comprises:

a substantially planar section terminating in an upper and lower flange, both of which flanges project toward the inside frame member, and a supporting rib formed in the planar section and projecting outwardly and away from said inside member, said supporting rib adapted to engage with a portion of a ceiling grid system, thereby supporting the support frame in the ceiling grid, and said inside frame member comprising:

an extruded formation which further comprises:

a substantially planar section terminating in an upper and lower flange substantially identical to and projecting towards the flanges of said outside frame member, and a projecting shelf formed in said inside frame member on a side opposite from said flanges and projecting outwardly therefrom, adapted to receive and support a portion of a light-reflection unit.

20. A composite surrounding support frame as described in claim 19, wherein said cross frame members are U-shaped channel, extruded formation which further comprise:

a planar base located between opposing outer and inner side walls;

a supporting rib horizontally projecting outwardly from said outer side wall in the same horizontal plane as said base, adapted to engage with an additional portion of the suspended ceiling grid system;

a horizontal shelf projecting outwardly from said inner side wall, coplanar with said base, and adapted to receive and support a portion of a light-reflection unit;

a pair of opposing lower flanges directed towards one another, thereby forming a false opening, and further comprising:

an outer flange attached to the lower end portion of said outer wall, said wall extending below the plane of said base, and an inner flange attached to a lower end portion of said inner wall, said wall extending below the plane of said base, both of said flanges being substantially identical to and projecting towards one another.

21. A composite surrounding support frame as described in claim 20, wherein said means joining the first and second frame members comprises a corner member, which further comprises:

a cast formation having a cross-frame extension and a lateral-frame extension formed at a selected angle to one another, said cross-frame extension adapted to be received by the base and opposing side walls of said cross frame, and said lateral-frame extension adapted to be received by the outer and inner frame of said lateral-frame members, whereby the corner member joins the cross-frame and lateral-frame members together forming a an angular connection

22. A composite surrounding support frame as described in claim 21, wherein said corner member further comprises:

a horizontal base, extending a selected distance in two directions, forming a cross-frame base extension and a lateral-frame base extension, each of said extensions having two longitudinal sides and an end;

an outer side wall attached to the outer longitudinal side of both base extensions forming a cross-frame outer side wall and a lateral-frame outer side wall;

an inner side wall attached to the inner side of both base extensions, forming a cross-frame inner side wall and a lateral-frame inner side wall; and an end wall attached to the end of each of said extensions, forming a cross-frame end wall and a lateral-frame end wall, whereby a U-shaped trough is formed having closed ends, with a bend of a selected angle located therein.

23. A composite surrounding support frame as described in claim 22, wherein apertures are formed in the inner and outer side walls of the corner cross-frame and lateral-frame extensions of a size suitable for use with fastening means for attaching said corner side walls to adjacent inner and outer lateral frame members and to adjacent outer and inner walls of said cross-frame members all of which also having apertures formed therein, thus forming a corner connection.

24. A composite surrounding support frame as described in claim 22, whereby top edges of said corner lateral-frame walls are vertically offset from top edges of said corner cross-frame walls.

25. A composite surrounding support frame as described in claim 24 wherein the cross-frame base extension is above and vertically offset from the lateral-frame base extension, such that when such cross-frame base extension is received by said cross-frame member, the bottom surface of the cross-frame base is coplanar with the bottom surface of the lateral-frame base extension.

26. A composite surrounding support frame as described in claim 24, wherein said cross-frame extension is received by said cross-frame member with said corner cross-frame walls substantially equal in vertical height to said outer and inner walls of the cross frame.

27. A composite surrounding support frame as described in claim 26, wherein the top edges of said corner lateral-frame walls are received by the upper flanges of said lateral-frame members, the corner walls being of a selected height such that the lower flanges of said lateral-frame members are coplanar with the lower flanges of said cross-frame members.

28. A composite surrounding support frame as described in claim 22, and further comprising a cover means suspended above and in superimposed relationship with the air discharge means.

29. A composite surrounding support frame as described in claim 28, wherein said cover means comprises:

a stamped, predominently planar formation having downwardly-bent lateral portions forming eaves and at least one bent end portion forming an end-support panel, said end panel attached to a portion of the surrounding support frame.

30. A composite surrounding support frame as described in claim 29, wherein the end support panel is attached to the lateral-frame end wall of a corner member.

31. A composite surrounding support frame as described in claim 22, and further comprising a means for controlling air flow in at least one of said pair of lateral-frame members.

32. A composite surrounding support frame as described in claim 31, wherein said means for controlling air flow comprises:

a pair of stamped, U-shaped channel stock, each having two opposing side walls and a base portion in between, one of said pair being inverted with one of the side walls received by the side walls of the other of said channel stock, forming a construction with a lateral dimension that may selectively be enlarged; and means for mounting the channel stock within the lateral-frame members.

33. A composite surrounding support frame as described in claim 32, wherein said mounting means comprises a spacer unit inserted between and separating the lateral outside and inside frame members, said spacer unit comprising:

a vertical member;

a plurality of horizontal flanges, vertically spaced along said vertical member, forming channel stock receiving slots between adjacent flanges; and a platform formed in a lateral-frame end wall of a corner member, adapted to receive the inverted pair of channel stock and permit full lateral movement of the stock, whereby one end of the channel stock is received by the platform formed in an end wall of a corner member and the other end of the stock is received by a slot of a spacer unit, both the spacer unit and the end-wall platform permit full lateral expansion of the inverted channel stock.

34. A composite surrounding support frame as described in claim 22, and further comprising means for positioning the light and air ventilation fixture at preselected locations on the suspended ceiling grid.

35. A composite surrounding support frame as described in claim 34, wherein said positioning means comprises:

at least one placement clip attached to and projecting away from the outer side walls of the surrounding support frame of a size receivable by any one of a plurality of slots selectively located along an upper box portion of main and cross runners located in the suspended ceiling grid.

* * * * *